US007562871B2

(12) United States Patent
Haasl et al.

(10) Patent No.: US 7,562,871 B2
(45) Date of Patent: Jul. 21, 2009

(54) PRESSURIZED AIR ASSIST SYSTEM FOR FEEDING OVERLAPPING SHEETS TO AN INTERFOLDER

(75) Inventors: Andrew L. Haasl, Green Bay, WI (US); David J. Stubenvoll, DePere, WI (US)

(73) Assignee: Fabio Perini S.p.A., Lucca (IT)

( * ) Notice: Subject to any disclaimer, the term of this patent is extended or adjusted under 35 U.S.C. 154(b) by 224 days.

(21) Appl. No.: 11/470,737

(22) Filed: Sep. 7, 2006

(65) Prior Publication Data

US 2007/0057449 A1 Mar. 15, 2007

Related U.S. Application Data

(60) Provisional application No. 60/715,091, filed on Sep. 8, 2005.

(51) Int. Cl.
*B65H 29/54* (2006.01)

(52) U.S. Cl. ..... 271/309; 271/310; 271/194; 271/195; 271/196; 271/69

(58) Field of Classification Search ..... 271/309, 271/310, 194–196, 69; 83/24, 99, 331, 343, 83/345, 346; 242/562, 562.1, 615.11
See application file for complete search history.

(56) References Cited

U.S. PATENT DOCUMENTS 4,000,942 A * 1/1977 Ito et al. ..... 399/398
4,420,152 A * 12/1983 Miyashita ..... 271/309
4,482,240 A * 11/1984 Kuge et al. ..... 399/296
4,625,952 A * 12/1986 Schniter et al. ..... 270/52.28
4,786,046 A * 11/1988 Freeman et al. ..... 271/276
4,882,606 A * 11/1989 Deguchi ..... 399/316
5,046,712 A * 9/1991 Clapp et al. ..... 271/65
5,337,456 A * 8/1994 Clement ..... 19/115 R
5,427,368 A * 6/1995 Abe et al. ..... 271/283
5,517,292 A * 5/1996 Yajima et al. ..... 399/323
6,453,128 B2 * 9/2002 Park ..... 399/22

(Continued)

FOREIGN PATENT DOCUMENTS

DE 1561738 3/1971

(Continued)

*Primary Examiner*—Patrick H Mackey
*Assistant Examiner*—Prasad V Gokhale
(74) *Attorney, Agent, or Firm*—Boyle Fredrickson, S.C.

(57) ABSTRACT

A sheet supply system, for use in supplying overlapped sheets to an interfolder, includes a bed roll on which a web is cut into successive sheets. The sheets are supplied to a sheet supply passage leading to retard rolls, which overlap the sheets within the supply passage. The trailing portion of each downstream sheet bulges outwardly as the sheet is supplied to the supply passage. An air tube directs pressurized air into a volume within which the bulge in the downstream sheet is formed. The pressurized air prevents the leading portion of the upstream sheet from being drawn outwardly along with the trailing area of the downstream sheet, by counteracting a vacuum that results from outward movement of the trailing portion of the downstream sheet after it is released from the bed roll. The pressurized air also maintains the upstream sheet in engagement with stripper fingers that guide the sheets through the sheet supply passage, and ensures separation between the trailing end of the downstream sheet and the leading end of the upstream sheet.

5 Claims, 4 Drawing Sheets

U.S. PATENT DOCUMENTS

| | | | | |
|---|---|---|---|---|
| 6,494,452 | B1 | 12/2002 | Karasiewicz | |
| 6,795,676 | B2 * | 9/2004 | Kikuchi et al. | 399/323 |
| 6,896,251 | B2 * | 5/2005 | Stephan | 271/9.07 |
| 6,899,327 | B2 * | 5/2005 | Shimizu et al. | 271/276 |
| 7,017,491 | B2 * | 3/2006 | Edamitsu | 101/477 |

FOREIGN PATENT DOCUMENTS

| | | |
|---|---|---|
| DE | 1949901 | 4/1971 |
| EP | 1524223 | 4/2005 |
| JP | 57 121542 | 7/1982 |
| WO | WO 98/35899 | 8/1998 |

* cited by examiner

PRESSURIZED AIR ASSIST SYSTEM FOR FEEDING OVERLAPPING SHEETS TO AN INTERFOLDER

CROSS REFERENCE TO RELATED APPLICATIONS

This application claims the benefit of U.S. provisional patent application Ser. No. 60/715,091 filed Sep. 8, 2005.

BACKGROUND AND SUMMARY

In a typical interfolding system, a web is cut into a series of successive sheets on a bed roll, which includes vacuum ports that maintain the leading edge of each sheet in engagement with the surface of the bed roll. The sheets are fed from the bed roll to a series of stripper fingers, and guides are located adjacent the stripper fingers to form a sheet supply passage that leads to a nip formed by a pair of retard rolls. A pick roll forms a nip with the bed roll, and engages the trailing end of each sheet to lift the trailing end of the sheet off the bed roll. The speed of rotation of the retard roll is slower than the rate of advancement of the sheets in the supply passage, which advances the stream of sheets in the discharge passage at a rate slower than the speed of advancement of the sheet on the bed roll. In this manner, when the trailing end of a downstream sheet is lifted off the bed roll by the pick roll, the leading end of the successive upstream sheet is advanced by the bed roll past the trailing end of the downstream sheet, which causes the successive sheets to overlap or "shingle" within the supply passage. The retard rolls supply the stream of shingled or overlapped sheets to the folding rolls, which interfold the sheets to form an interfolded stack of sheets.

Due to engagement of the trailing portion of each sheet with the pick roll as the sheet is discharged from the bed roll, the trailing portion of each sheet bulges or bubbles outwardly as the sheet is moved into the stream of shingled or overlapped sheets in the sheet supply passage en route to the retard rolls. The bulge or bubble in each sheet is controlled by a transverse control bar that is positioned below the pick roll and outwardly of the stripper fingers, above the guides that cooperate with the stripper fingers to form the sheet supply passage.

A system such as this functions well at certain speeds, e.g. up to approximately 350 sheets per minute. It has been found that, at higher speeds of operation, the system experiences certain adverse effects that result in unsatisfactory performance, particularly in the sheet overlapping area. Specifically, it is believed that, when the trailing portion of a sheet is moved outwardly by operation of the pick roll to form the bubble or bulge in the trailing portion of the sheet, the leading portion of the successive upstream sheet is drawn outwardly along with the bubble or bulge in the trailing area of the downstream sheet. Such outward movement of the leading portion of the upstream sheet causes the leading edge of the upstream sheet to strike the downstream sheet, which causes misalignment between the sheets and inaccurate positioning between the trailing edge of the downstream sheet and the leading edge of the adjacent upstream sheet.

The object of the present invention is to overcome the above-described problem to enable operation of the interfolder at high speeds.

In accordance with the present invention, pressurized air is introduced between the trailing area of the downstream sheet and the leading area of the successive upstream sheet, to prevent the leading portion of the upstream sheet from being drawn outwardly along with the bubble or bulge in the trailing area of the downstream sheet. The pressurized air is introduced using a transversely extending air supply tube or pipe, which is positioned below the pick roll and above the transverse control bar. The air supply tube or pipe includes openings, such as slots or holes, that are oriented so as to direct a flow of pressurized air below the pick roll and above the transverse control bar, into a volume within which is formed the bubble or bulge between the trailing end area of the downstream sheet and the leading end area of the upstream sheet. The pressurized air functions to counteract the vacuum that otherwise results from the outward movement of the trailing portion of the downstream sheet after it is released from the bed roll and moves outwardly by operation of the pick roll to form the bubble or bulge in the trailing end area of the downstream sheet. The introduction of pressurized air into the volume thus maintains the leading end area of the upstream sheet in engagement with the stripper fingers or other structure that is used to guide the overlapped sheets through the sheet supply passage toward the retard rolls, downstream of the bed roll. At the same time, the pressurized air functions to force the trailing area of the downstream sheet outwardly against the transverse control bar, to ensure adequate separation between the trailing end area of the downstream sheet and the leading end area of the upstream sheet and to enable the leading edge of the upstream sheet to be fed from the bed roll into the volume without interference from the trailing end of the downstream sheet.

The pressurized air is constantly directed toward the volume within which the leading end of the upstream sheet is supplied. The pressurized air impinges on the downstream sheet, and may be directed into the volume via grooves formed in the pick roll. When the trailing end of the downstream sheet is engaged with the pick roll, typically via a series of laterally spaced vacuum ports that open onto the surface of the pick roll, the pressurized air passes into the volume by separations formed between the downstream sheet and the surface of the pick roll between the vacuum ports, in addition to the grooves in the surface of the pick roll. Once the trailing end of the downstream sheet is released from engagement with the pick roll, the pressurized air is supplied into the volume through a space defined between the trailing end of the sheet and the surface of the pick roll as the sheet is advanced downstream relative to the pick roll.

The invention contemplates a sheet supply system for use with an interfolder in accordance with the foregoing summary, as well as a method of supplying successive overlapped sheets to an interfolder, also in accordance with the foregoing summary.

Various other features, objects and advantages of the invention will be made apparent from the following detailed description taken together with the drawings.

BRIEF DESCRIPTION OF THE DRAWINGS

The drawings illustrate the best mode presently contemplated of carrying out the invention.

In the drawings.

DETAILED DESCRIPTION

Figure 1:
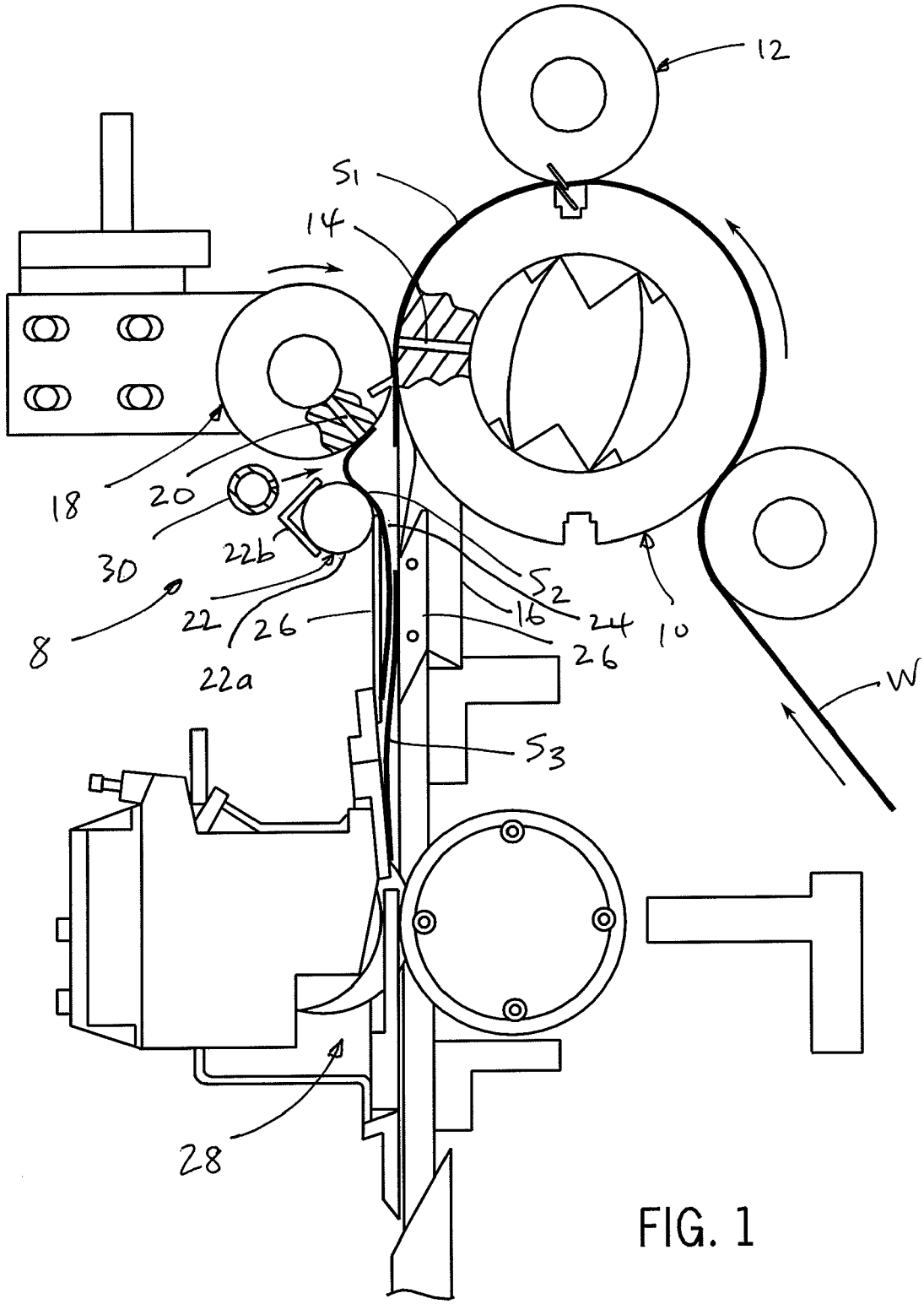
FIG. 1 is a schematic side elevation view of a sheet supply system in accordance with the present invention, such as for use in supplying successive overlapped sheets to an interfolder.

With reference to the drawings, a sheet supply system 8 in accordance with the present invention includes a sheet supply roll in the form of a bed roll 10, which cooperates with a knife roll 12 in a known manner to form successive sheets, such as shown at S1 and S2, from a web W. The bed roll 10 has axially aligned sets of radially spaced vacuum ports 14 that maintain the leading portion of each sheet, such as sheet S1, in engagement with the bed roll. The vacuum ports 14 are oriented on the surface of bed roll 10 so as to be located upstream of the leading edge of each sheet, so that the leading edge of each sheet is stripped off the bed roll 10 upon counterclockwise rotation of the bed roll 10 by a series of stripper fingers, shown at 16. In a manner as is known, the stripper fingers 16 extend into grooves 17 formed in the bed roll 10, and engage the leading end area of each sheet as the sheets are advanced by rotation of bed roll 10 so as to strip the sheets off the surface of the bed roll 10.

A pick roll 18 is located adjacent the bed roll 10, and includes axially aligned sets of radially spaced vacuum ports 20 that engage the trailing portion of each sheet as the sheet is released from the bed roll 10. In the drawings, the pick roll ports 20 are shown maintaining the trailing area of sheet S2, which is the sheet downstream of sheet S1, in engagement with the pick roll 18.

A transversely extending control member, in the form or a control bar 22, is located downstream of the nip defined between pick roll 18 and bed roll 10. The control bar 22 extends generally parallel to the longitudinal axes of pick roll 18 and bed roll 10, and is laterally spaced from the facing edges of stripper fingers 16. In the illustrated embodiment, control bar 22 is in the form of a round support bar member 22*a* to which an angle member 22*b* is secured, although it is understood that control bar 22 may have any other desired configuration. Control bar 22 is located at the entrance to a sheet supply passage 24, which is defined between stripper fingers 16 and the outer one of a pair of spaced apart guides 26. An inner one of the spaced apart guides 26 defines a guide edge in alignment with the stripping edge defined by an adjacent one of stripper fingers 16, and defines a continuous sheet guiding surface within sheet supply passage 24 leading to a nip defined between a pair of retard rolls, shown at 28. In a manner as is known, the rate of rotation of retard rolls 28 is such that retard rolls 28 advance the stream of overlapped sheets in passage 24 more slowly than the speed at which the sheets are discharged from the nip between pick roll 18 and bed roll 10. In this manner, the leading end area of each upstream sheet is advanced past the trailing end area of each downstream sheet, to shingle or overlap the successive sheets that are supplied to passage 24. From the discharge of retard rollers 28, the overlapped sheets may be supplied to an interfolder to form an interfolded stack of sheets in a known manner.

When the trailing end area of a sheet, such as sheet S2, is maintained in engagement with pick roll 18 by vacuum ports 20, the clockwise rotation of the pick roll 18 functions to move the trailing end area of the sheet S2 outwardly relative to the stripper fingers 16 when the sheet S2 passes downstream from the nip between pick roll 18 and bed roll 10. Such outward movement of sheet S2 moves the sheet S2 into engagement with control bar 22 and functions to form a bubble or bulge B to form in sheet S2, which thus defines a space between the trailing end area of the downstream sheet S2 and the leading end area of the upstream sheet S1. In this manner, the leading end area of the upstream sheet S1 is advanced relative to the trailing end area of the downstream sheet S2, to cause an overlap in the successive sheets S1 and S2.

When the trailing end area of sheet S2 is moved outwardly by pick roll 18 to form bulge B in sheet S2, a volume V is defined by sheet S2 in combination with the outer guide edges of stripper fingers 16 and the nip between pick roll 18 and bed roll 10. At relatively high speeds of operation, it has been found that the leading end area of each upstream sheet, such as S1, tends to follow the trailing end area of each downstream sheet, such as S2, within volume V when the trailing end area of the downstream sheet is moved outwardly by operation of pick roll 18. It is believed that a slight vacuum is formed within volume V by such outward movement of the trailing end area of the downstream sheet, which tends to draw the leading end area of the upstream sheet outwardly within volume V along with the trailing end area of the downstream sheet. Such outward movement of the upstream sheet prevents proper advancement of the leading end area of the upstream sheet to form the desired overlap with the trailing end area of the downstream sheet, which forms a limitation on the speed at which the sheets can be supplied to the retard rolls 28.

To counteract this limitation, and in accordance with the present invention, pressurized air is supplied to volume V in order to ensure proper separation between the trailing end area of each downstream sheet and the leading end area of each upstream sheet. In the illustrated embodiment, the pressurized air is supplied to volume V through an air supply pipe or tube 30 positioned below pick roll 18 and above control bar 22. A series of openings 32 are formed in air supply tube 30 along its length, and are oriented so as to point toward volume V in a direction generally tangential relative to the outer surface of pick roll 18. Openings 32 may be in the form of circular openings or slots, and are formed so as to enable the air flow from the internal passage of air supply tube to be directed toward volume V along the length of pick roll 18. The pressurized air is supplied from openings 32 toward volume V in the direction of arrow 34.

Figure 2:
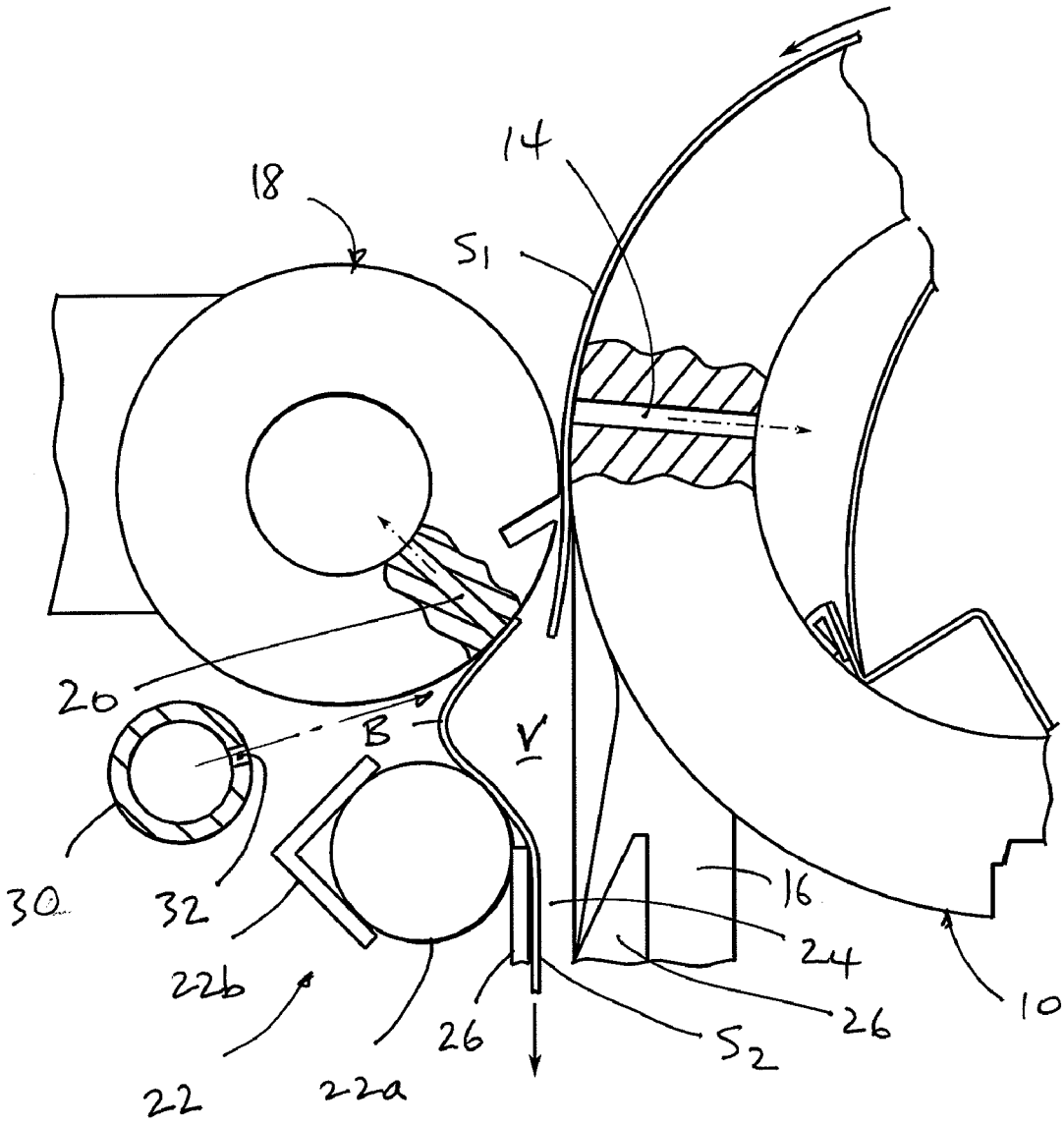
FIG. 2 is an enlarged partial side elevation schematic view of a portion of the sheet supply system of FIG. 1, showing a downstream sheet moved outwardly relative to an upstream sheet.
Figure 3:
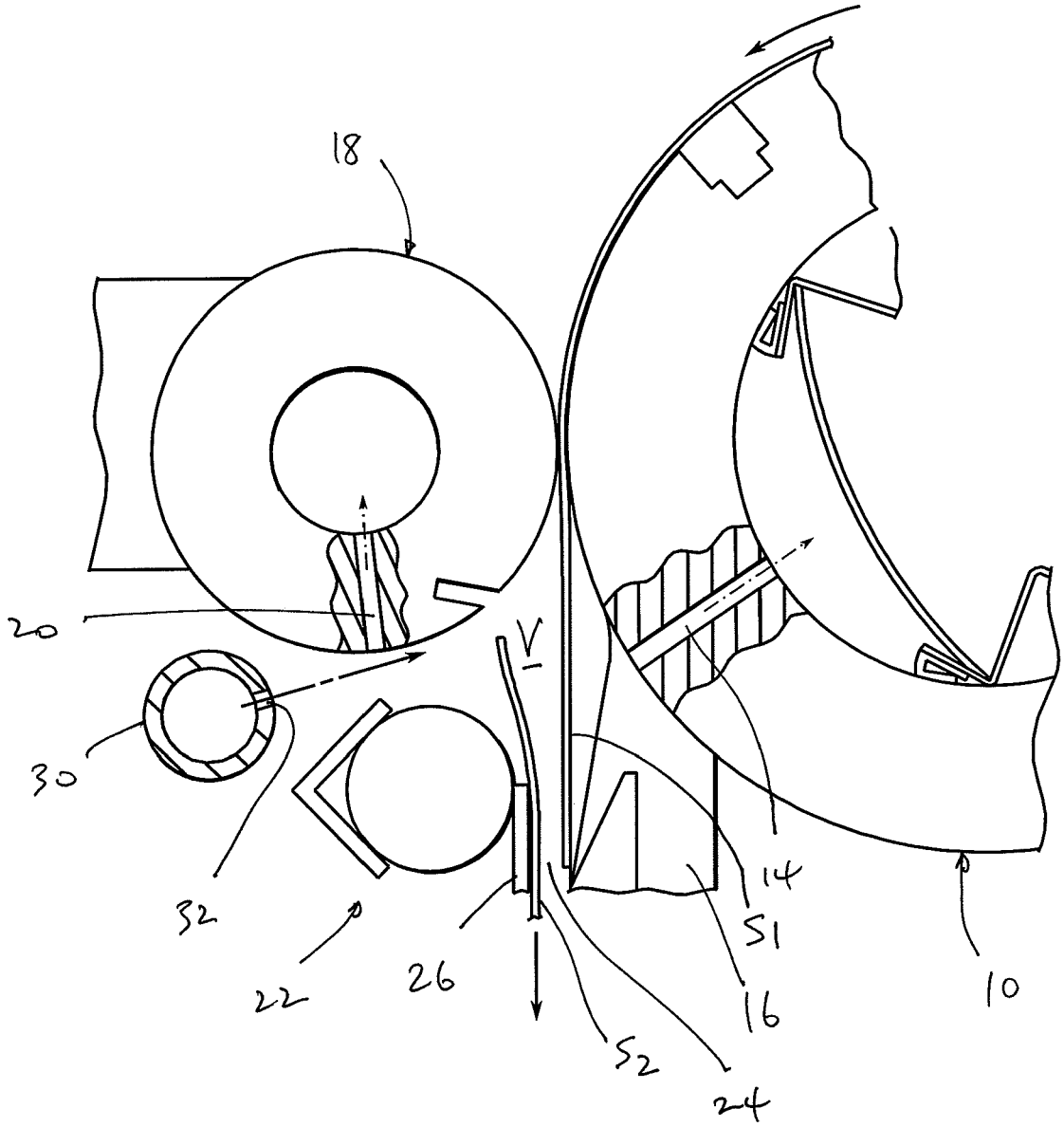
FIG. 3 is an enlarged partial side elevation view similar to FIG. 2, showing advancement of the downstream and upstream sheets and operation of the pressurized gas supply in accordance with the present invention in maintaining separation between the trailing end portion of the downstream sheet and the leading end portion of the upstream sheet.
Figure 4:
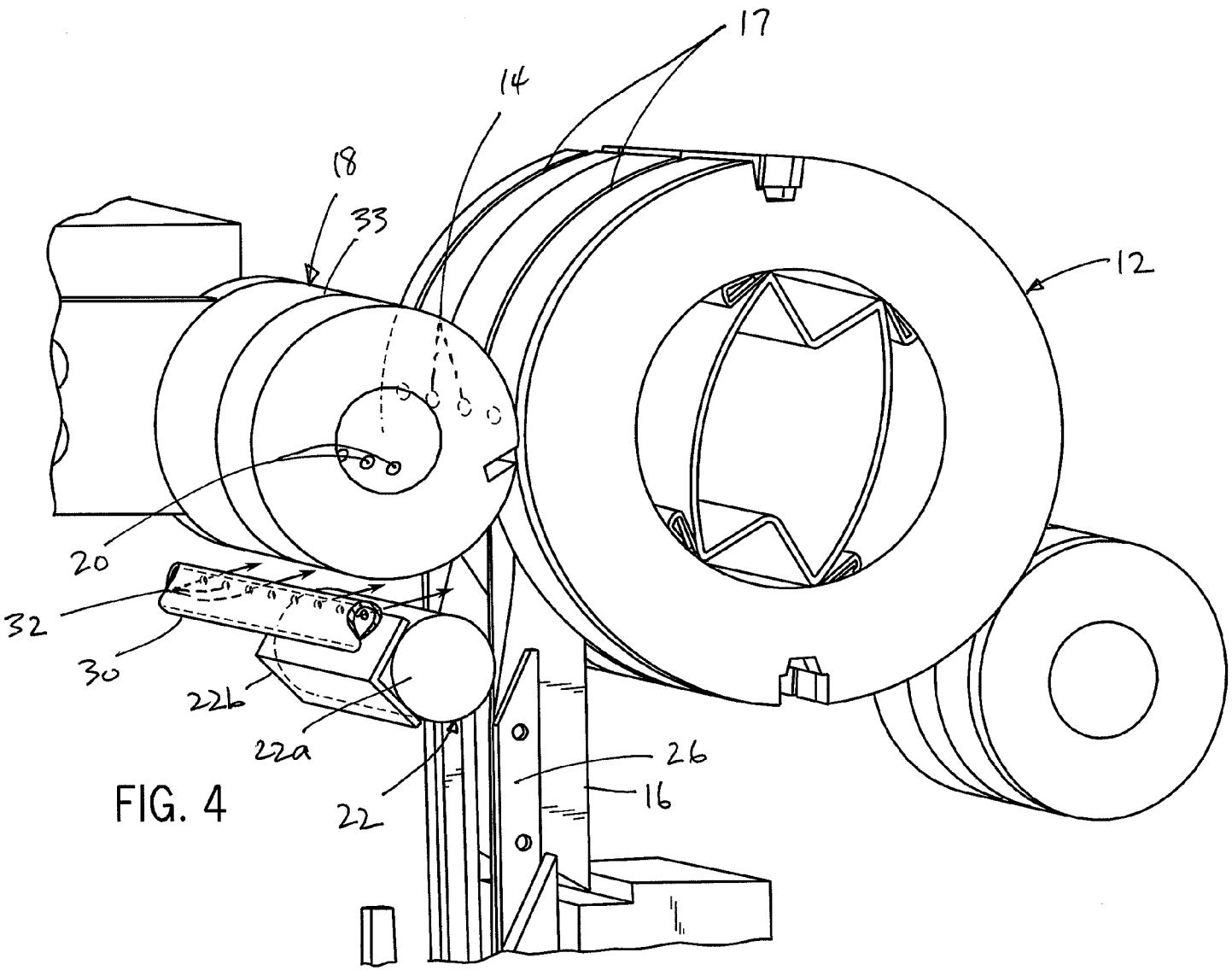
FIG. 4 is an enlarged partial isometric view of the portion of the sheet supply system shown in FIGS. 3 and 4.

The pressurized air from air supply tube 30 is supplied toward volume V in a constant stream. While the trailing end area of the downstream sheet S2 remains in engagement with the pick roll 18 by operation of vacuum ports 20, the pressurized air stream simply impinges on the outer surface of the sheet S2 as the sheet S2 is advanced, as shown in FIG. 2. At this time, the pressurized air may be directed into the volume via grooves formed in the pick roll, which may be located between the pick roll vacuum ports 20. When the trailing end of the downstream sheet S2 is engaged with the pick roll 18 by operation of vacuum ports 20, the pressurized air passes into the volume V by separations formed between the sheet S2 and the surface of the pick roll 18 between the vacuum ports 20, in addition to the grooves 33 in the surface of the pick roll 18. Once the trailing end of the downstream sheet S2 is released from engagement with the pick roll 18, as shown in FIG. 3, the pressurized air is supplied into the volume V through a space defined between the trailing end of the sheet S2 and the surface of the pick roll 18 as the sheet S2 is advanced downstream relative to the pick roll. In this manner, the volume V is essentially maintained under a constant positive pressure, to counteract any vacuum that may be formed by outward movement of the trailing end area of sheet S2, and functions to maintain the leading end area of the upstream sheet S1 in engagement with the stripper fingers 16. The pressurized air stream also functions to force the trailing area of the downstream sheet S2 outwardly against the control bar 22, to ensure adequate separation between the trailing end of the downstream sheet S2 and the leading end of the upstream sheet S1. This positive separation enables the leading edge of the upstream sheet S1 to be fed from the bed roll 10 into the volume V without interference from the trailing end of the downstream sheet S2.

While the pressurized air supply has been shown and described as a tube or pipe located exteriorly of the volume V and exteriorly of the pick roll 18 and the transverse bar 22, it is also contemplated that the present invention contemplates application of pressurized air into the volume V by any other satisfactory means. It is also understood that the pressurized air may be supplied to the volume V from a location other than below pick roll 18 and above bar 22. For example, the pressurized air may be supplied from above pick roll 18 through the nip defined between pick roll 18 and bed roll 10. In an arrangement such as this, grooves are formed in pick roll 18 between the vacuum ports 20, and pressurized air is supplied to the grooves from a tube or pipe positioned above pick roll 18 that includes discharge openings in alignment with the pick roll grooves. It is also contemplated that the pressurized air may be supplied to the volume V from the location of air supply tube 30 as illustrated, through grooves formed in pick roll 18 and openings in air supply tube 30 in alignment with the pick roll grooves. In either of these embodiments, the pressurized air can be supplied to volume V while the trailing end area of the downstream sheet remains in engagement with the pick roll 18. In addition, while the sheet supply system of the present invention has been described in connection with supplying overlapped sheets to an interfolder, it is understood that the sheet supply system of the present invention is not limited to such an application and may be used in any application in which it is desired to supply a stream of overlapped sheets is formed.

It has been found that, with the pressurized air introduction system of the present invention, the speed of operation of a machine incorporating the present invention can be increased from approximately 350 sheets per minute up to approximately 700 sheets per minute. It can thus be appreciated that the present invention provides a relatively simple and inexpensive way to increase the speed of production of conventional cutting, folding and forming systems, which is not known in the prior art.

Various alternatives and modifications are contemplated as being within the scope of the following claims, which particularly point out and distinctly claim the subject matter regarded as the invention.

We claim:

1. A sheet supply system, comprising:

a sheet supply roll for supplying successive upstream and downstream sheets;

a sheet supply passage located downstream of the sheet supply roll for receiving the sheets from the sheet supply roll;

a retard roll arrangement located downstream of the sheet supply passage for receiving the sheets from the sheet supply passage and slowing the rate of advancement of the sheets, including the downstream sheet, relative to the upstream sheet;

a pick roll located adjacent the sheet supply roll for engaging the trailing end area of the downstream sheet and moving the trailing end area of the downstream sheet outwardly as the leading end area of the upstream sheet is advanced into an overlapping relationship relative to the trailing end area of the downstream sheet; and a pressurized gas supply arranged to introduce pressurized gas into an area downstream of the pick roll and upstream of the sheet supply passage, wherein the pressurized gas supply functions to separate the trailing end area of the downstream sheet from the leading end area of the upstream sheet.

2. The sheet supply system of claim 1, further comprising a control member located downstream of the sheet supply roll and the pick roll, wherein the control member cooperates with the pick roll to form a bulge in the trailing end area of the downstream sheet as the trailing end area of the downstream sheet is moved outwardly by operation of the pick roll, and wherein the pressurized gas supply introduces pressurized gas between the pick roll and the control member when the trailing end area of the downstream sheet is moved out of engagement with the pick roll.

3. The sheet supply system of claim 2, wherein the pressurized gas supply comprises a gas supply tube that extends generally parallel to a longitudinal axis defined by the pick roll, wherein the gas supply tube includes a series of openings that extend from an internal passage defined by the gas supply tube and that open onto an exterior defined by the gas supply tube, and wherein the openings are formed in the gas supply tube so as to face the area downstream of the pick roll and upstream of the sheet supply passage.

4. The sheet supply system of claim 1, further comprising a stripper arrangement that disengages the sheets from the sheet supply roll and that guides the sheets from the sheet supply roll to the sheet supply passage, and wherein the pressurized gas supply is configured and arranged to direct the pressurized gas toward the stripper arrangement such that the pressurized gas impinges on the leading end area of the upstream sheet as the leading end area of the upstream sheet is being moved off the sheet supply roll by the stripper arrangement.

5. An interfolding machine comprising:

a sheet supply roll;

a knife roll that cooperates with the sheet supply roll to supply successive upstream and downstream sheets;

a sheet supply passage located downstream of the knife roll for receiving the sheets from the knife roll;

a retard roll arrangement located downstream of the sheet supply passage for receiving the sheets from the sheet supply passage and slowing the rate of advancement of the sheets, including the downstream sheet, relative to the upstream sheet;

a pick roll located adjacent the sheet supply roll for engaging the trailing end area of the downstream sheet and moving the trailing end area of the downstream sheet outwardly as the leading end area of the upstream sheet is advanced into an overlapping relationship relative to the trailing end area of the downstream sheet;

a control member located downstream of a nip defined between the pick roll and the sheet supply roll for advancing the downstream sheet from the pick roll to the retard roll arrangement; and a pressurized gas supply arranged to introduce pressurized gas into an area downstream of the pick roll and upstream of the control member, wherein the pressurized gas supply functions to separate the trailing end area of the downstream sheet from the leading end area of the upstream sheet.

* * * * *